US006620000B1

(12) United States Patent
Chen

(10) Patent No.: US 6,620,000 B1
(45) Date of Patent: Sep. 16, 2003

(54) CONNECTOR FOR CONNECTING ELECTRIC WIRE TO A SWITCH

(76) Inventor: Wen-Pin Chen, No. 1-7, Lane 251, Te Shan Rd., Jen-Te Hsiang, Tainan Hsien (TW)

( * ) Notice: Subject to any disclaimer, the term of this patent is extended or adjusted under 35 U.S.C. 154(b) by 0 days.

(21) Appl. No.: 10/287,520

(22) Filed: Nov. 5, 2002

(51) Int. Cl.[7] ..... H01R 4/48; H01R 13/60; H01R 13/66; H01H 1/34

(52) U.S. Cl. ..... 439/835; 200/249; 439/535

(58) Field of Search ..... 439/835, 836, 439/535; 174/53; 200/249, 251, 259, 261

(56) References Cited

U.S. PATENT DOCUMENTS 3,710,305 A * 1/1973 Clark ..... 439/415
4,223,971 A * 9/1980 Dola et al. ..... 439/395
4,958,048 A * 9/1990 Bell ..... 174/53
5,064,977 A * 11/1991 Fierro ..... 200/293
5,195,907 A * 3/1993 Urban ..... 439/410
5,785,551 A * 7/1998 Libby ..... 439/535
5,975,938 A * 11/1999 Libby ..... 439/410

* cited by examiner

*Primary Examiner*—Chandrika Prasad
(74) *Attorney, Agent, or Firm*—Varndell & Varndell, PLLC

(57) ABSTRACT

A connector is adapted to connect electric wire to a switch. The connector includes an insulation block and at least one plug. The insulation block has a top, an attachment face and a rear face. Prong holes are defined in the attachment face and adapted to receive prongs of the switch. Positioning holes corresponding to one of the at least one plugs are defined in the insulation block from the attachment face to the rear face respectively. A conductor hole is defined in the insulation block at the top and communicates with adjacent positioning holes and prong holes. A conductor of the electric wire is inserted into the conductor hole. The conductor is pressed against the prong in the prong hole.

6 Claims, 5 Drawing Sheets

CONNECTOR FOR CONNECTING ELECTRIC WIRE TO A SWITCH

BACKGROUND OF THE INVENTION

1. Field of the Invention

The present invention relates to a connector, and more particularly to a connector for connecting electric wires to prongs of a switch easily and quickly.

2. Description of Related Art

Electric switches turn electricity on or off to a device run by electricity. With reference to FIG. 6, a conventional electric switch (20) is adapted to electrically connect to two wires (30). The switch (20) has three prongs (21) to which wires (30) are electrically connected. The wire (30) has a conductor (31) that is adapted to conduct a current, and insulating material surrounds and isolates the conductor (31).

The conductor (31) of the electric wire (30) can be directly soldered to the prong (21). With further reference to FIG. 7, another method of attaching the wire (30) to the prong (21) is to define a threaded hole (not shown) in each prong (21). After winding the conductor (21) around a screw (22) with a head, the screw (22) is screwed into the threaded hole, and the screw (22) squeezes and holds the conductor (31) between the head of the screw (22) and the prong (21).

No matter which method is used, a tool such as a screwdriver or a soldering iron is always needed to attach the conductor (31) to the prong (22). Getting the tools and attaching the wire (30) to the switch (20) can be very inconvenient.

To overcome the shortcomings, the present invention provides a connector for connecting the electric wire to switch to mitigate or obviate the aforementioned problems.

SUMMARY OF THE INVENTION

The main objective of the invention is to provide a connector for connecting wire to switch quickly and easily.

Another objective of the invention is to provide a connector for connecting wire without using a tool.

Other objectives, advantages and novel features of the invention will become more apparent from the following detailed description when taken in conjunction with the accompanying drawings.

DETAILED DESCRIPTION OF PREFERRED EMBODIMENT

Figure 1:
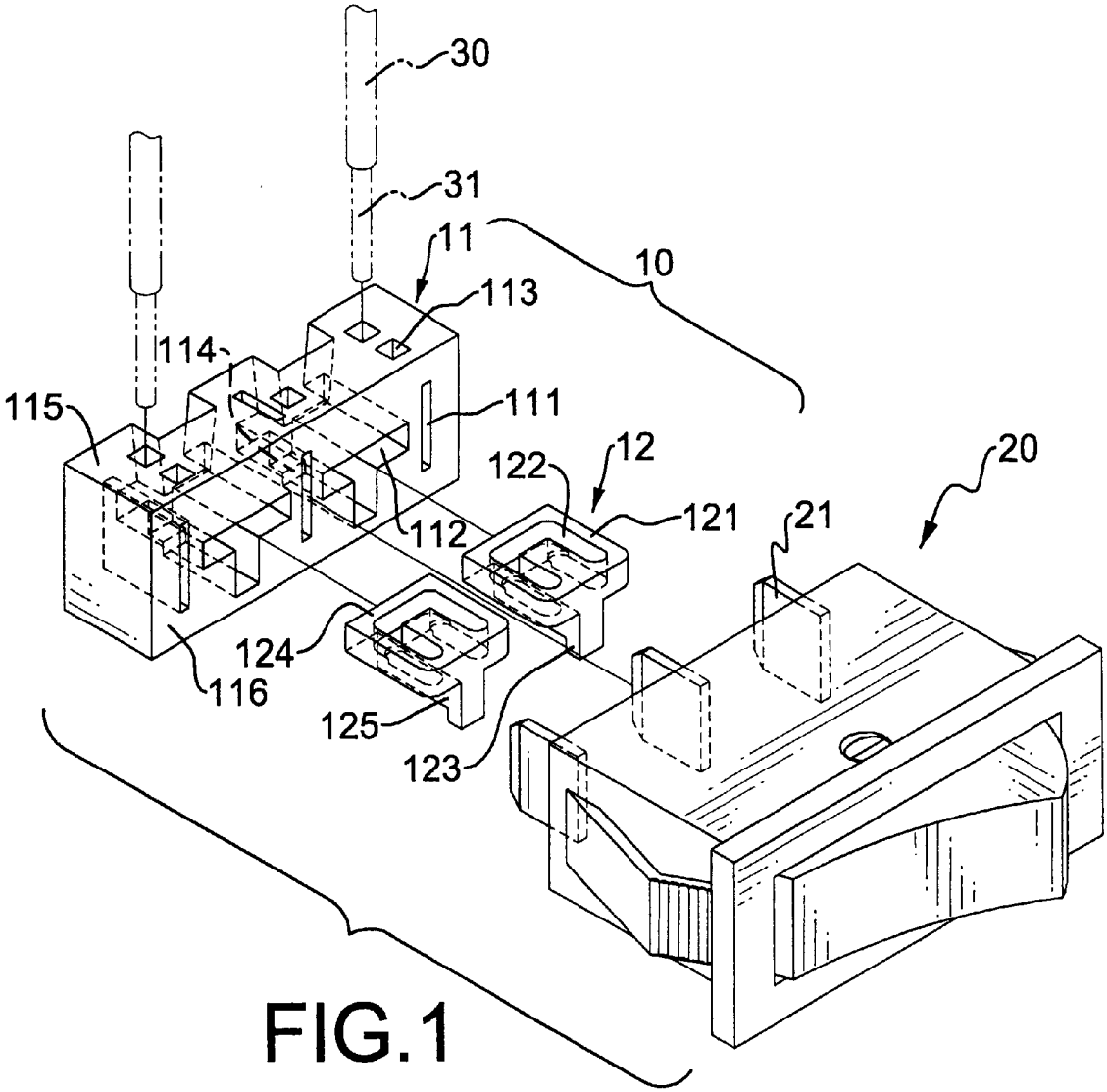
FIG. 1 is a perspective view of the connector in accordance of the present invention.

With reference to FIG. 1, a connector (10) in accordance with the present invention includes an insulation block (11) and two plugs (12). The connector (10) is adapted to connect electrically wires (30) to an electric switch (20). Generally, the switch (20) has three prongs (21), and the wire (30) has a conductor (31) to conduct a current. The prongs (21) are adapted to connect electrically to the conductor (31).

The insulation block (11) has a top (115), a bottom (not numbered), an attachment face (116) and a rear face (not numbered). The rear face is opposing to the attachment face (116). Three prong holes (111) are defined in the insulation block (11) at the attachment face (116) and adapted to the prongs (21) respectively inserted into the prong holes (111). A T-shaped positioning hole (112) is defined in the attachment face (116) of the insulation block (11) between adjacent prong holes (111), and the positioning hole (112) passes through the insulation block (11) from the attachment face (116) to the rear face and has a bottom corresponding to the bottom of the insulation block (11). At least one conductor hole (113) is defined vertically in the insulation block (11) through the top (115) and communicating with adjacent prong holes (111) and positioning holes (112). A stop (114) is formed near the rear face of the insulation block (11) in the bottom of the positioning hole (112).

The plug (12) is made of insulating material, has a shape corresponding to the positioning hole (112) and is adapted to insert into the positioning hole (112). The shape of the plug (12) is T-shaped and corresponds to the T-shaped positioning hole (112), but both the positioning hole (112) and the plug (12) can be flat shaped, crisscrossed shaped or other type shaped. The plug (12) has a flat top (124) and a bottom rib (125). The bottom rib (125) is formed integrally with the flat top (124). A U-shaped hole (122) is defined in the flat top (124) of each plug (12). The U-shaped hole (122) has two opposite sides (not numbered). A resilient portion (121) is formed at each opposite side of the U-shaped hole (122) respectively. A protrusion (123) is formed on the bottom rib (125) and adapted to about the stop (114) so the plug (12) only can be inserted into the positioning hole (112) from the attachment face (116) of the insulation block (11).

Figure 2:
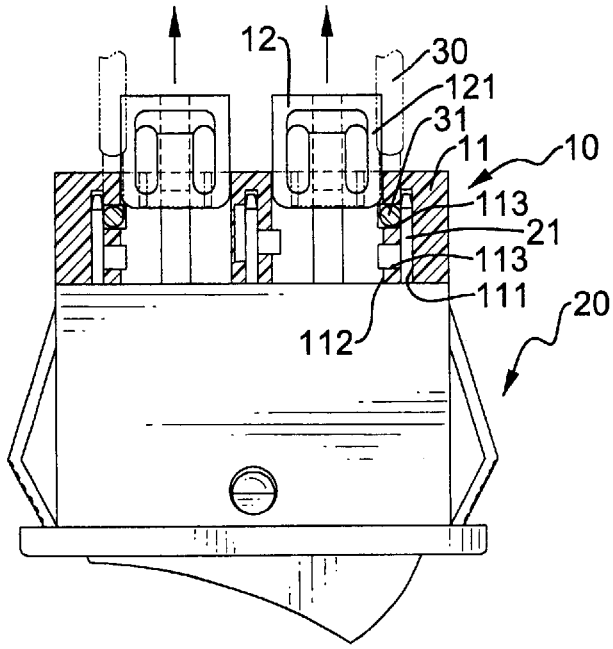
FIG. 2 is an operational top plan view in partial section of the connector in FIG. 1, when a plug is drawn out of a positioning hole.

With reference to FIG. 2, the switch (20) is attached firmly to the attachment face (116) of the insulation block (11), and each prong (21) is inserted into and held in the corresponding prong hole (111). The plug (12) is drawn out from the rear face of the insulation block (11) until the protrusion (123) abuts the stop (114). At this time, the conductor (31) of the electric wire (31) is inserted into the conductor hole (113).

Figure 3:
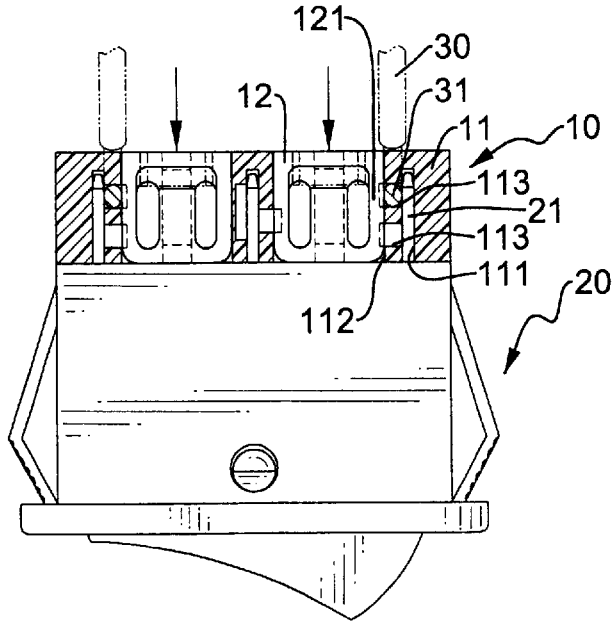
FIG. 3 is an operational top plan view in partial section of the connector in FIG. 1, when the plug is pushed into a positioning hole.

With reference to FIG. 3, pushing the plug (12) back into the positioning hole (112) squeezes and holds the conductor (31) in the conductor hole (113). The resilient portion (121) presses the conductor (31) in the conductor hole (113) against the prong (21). Thus, the electric wire (30) is electrically connected to the prong (21) of the switch (20).

Figure 4:
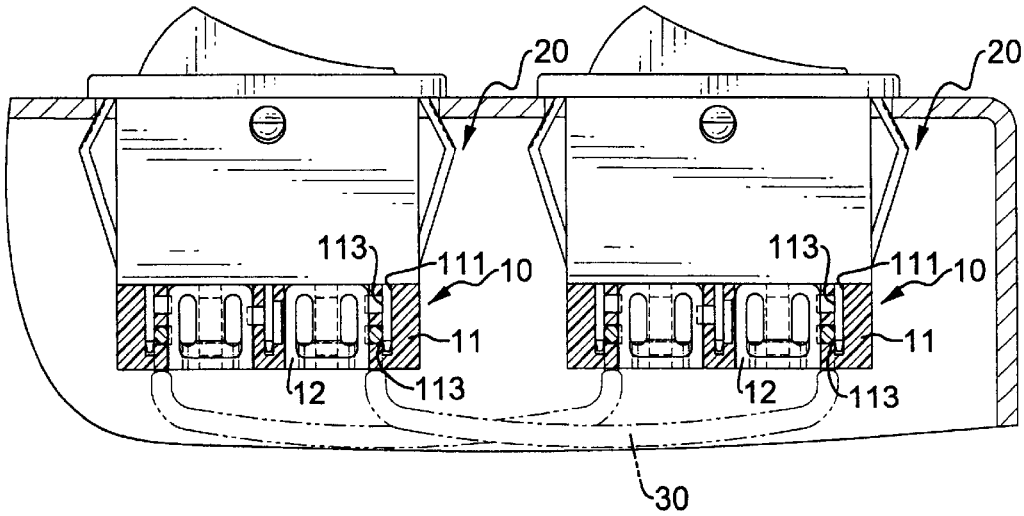
FIG. 4 is an operational top plan view of two switches in FIG. 3 electrically connected in series.

With reference to FIG. 4, two electric switches (20) that are attached to two connectors (10) respectively are connected electrically in series to each other by the electric wire (30) to increase application of the invention.

Figure 5:
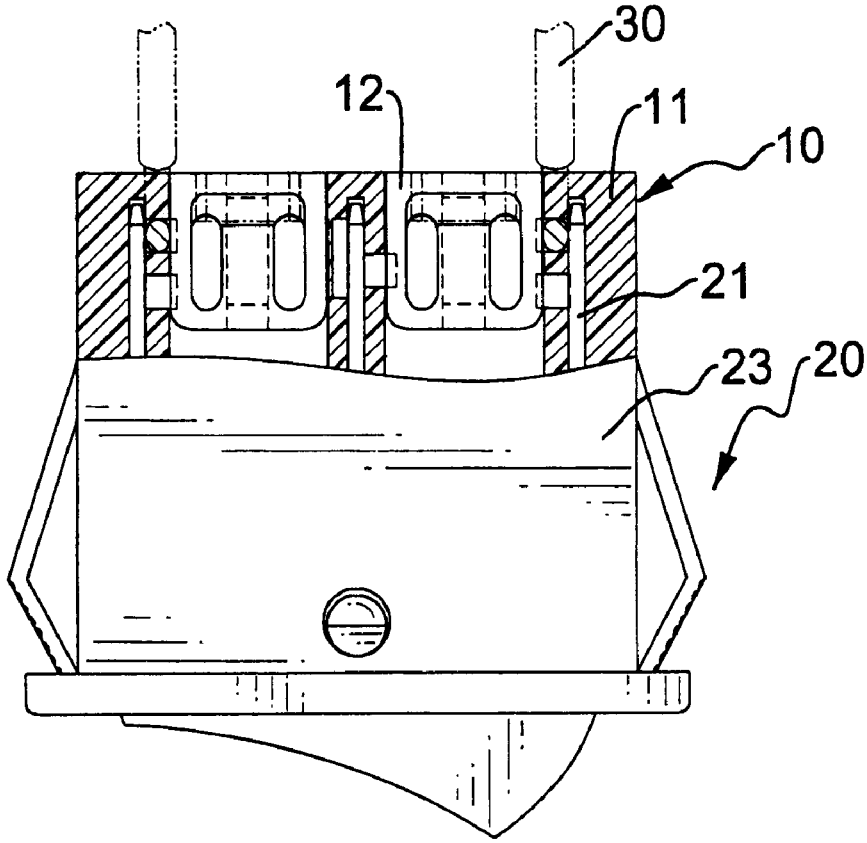
FIG. 5 is a top plan view of another embodiment of the the connector in accordance with the present invention.
Figure 6:
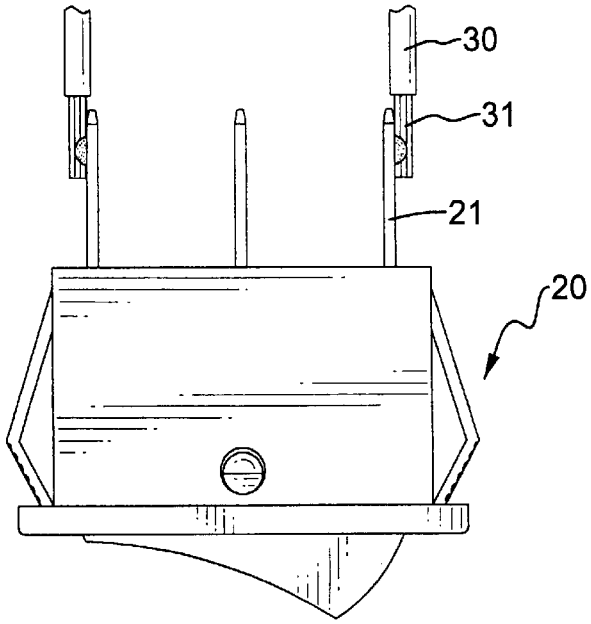
FIG.6 PRIOR ART
FIG. 6 is a top plan view of a conventional connector for connecting electric wire to a switch in accordance with the prior art.
Figure 7:
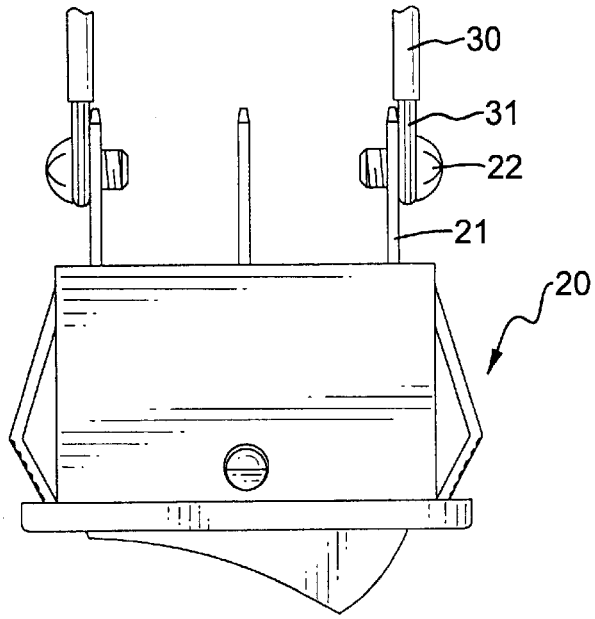
FIG.7 PRIOR ART
FIG. 7 is a top plan view of another conventional connector for connecting electric wire to a switch in accordance with the prior art.

With reference to FIG. 5, an alternative embodiment of the switch (20) further includes an insulating housing (23). The insulation block (11) of the connector (10) can be formed directly with the housing (23). The plugs (12) and the prongs (21) are mounted in the insulation block (11) prior to the assembly of the insulating housing (23) and the insulation block (11). Finally, the other elements of the switch (20) are assembled. Thus, the plugs (12) can be used to connect electrically the electric wire (30) to the prongs (21) of the switch (20).

Based on the foregoing description, a user can connect the electric wire (30) to the switch (20) easily and quickly without any tool. It is more convenient to the user to electrically connect the wire (30) to the switch (20).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector for connecting an electric wire to an electric switch, and the connector comprising:

an insulation block having a top, a bottom, an attachment face and a rear face away from the attachment face and the insulation block further comprising at least two prong holes defined in the attachment face of the insulation block and each of the at least two prong holes adapted to receive a prong of the switch;

a positioning hole defined in the insulation block between each pair of adjacent prong holes, and each positioning hole passing through the insulation block from the attachment face to the rear face; and at least one conductor hole defined in the insulation block through the top and corresponding to each respective one of the at least two prong holes, each at least one conductor hole communicating with the corresponding one of the at least two prong holes and the positioning hole adjacent to the at least one conductor hole, and each at least one conductor hole adapted to hold a conductor of an electric wire; and a plug moveably received in each respective positioning hole and having a shape corresponding to a shape of the positioning hole in which the plug is received, whereby when the plug is pushed into the positioning hole, the plug presses the conductor in the conductor hole against the prong of the switch in the prong hole.

2. The connector as claimed in claim 1, wherein each positioning hole and each plug are T-shaped, and each plug has a flat top and a bottom rib.

3. The connector as claimed in claim 2, wherein a stop is formed in each respective positioning hole at a bottom corresponding to the bottom of the insulation block, the stop is near the rear face of the insulation block, and a protrusion is formed on the bottom rib of the plug and the protrusion is adapted to abut the stop.

4. The connector as claimed in claim 2, wherein a U-shaped hole with two opposite sides is defined in a flat top of each respective plug, and a resilient portion is formed at each opposite side of the U-shaped hole respectively.

5. The connector as claimed in claim 3, wherein a U-shaped hole with two opposite sides is defined in a flat top of each respective plug, and a resilient portion is formed at each opposite side of the U-shaped hole respectively.

6. The connector as claimed in claim 5, wherein the insulation block has three prong holes defined in the attachment face of the insulation block;

a positioning hole defined in the insulation block between each pair of adjacent prong holes; and at least one conductor hole defined in the insulation block through the top and corresponding to each respective one of the prong holes, each at least one conductor hole communicating with the corresponding one of the prong holes and the positioning hole adjacent to the at least one conductor hole.

* * * * *